US005650380A

United States Patent [19]

Fletcher

[11] Patent Number: 5,650,380

[45] Date of Patent: Jul. 22, 1997

[54] LUBRICATING GREASE

[75] Inventor: Robert Anthony Fletcher, Chester, Great Britain

[73] Assignee: Shell Oil Company, Houston, Tex.

[21] Appl. No.: 664,469

[22] Filed: Jun. 14, 1996

[30] Foreign Application Priority Data

Jul. 11, 1995 [EP] European Pat. Off. ..... 95304827

[51] Int. Cl.[6] ..... C10M 141/02; C10M 141/06; C10M 141/08; C10M 141/10

[52] U.S. Cl. ..... 508/168; 508/169; 508/385

[58] Field of Search ..... 508/167, 168, 508/169, 365, 385

[56] References Cited

U.S. PATENT DOCUMENTS

| | | | |
|---|---|---|---|
| 2,363,013 | 11/1944 | Morway et al. | 508/385 |
| 3,684,726 | 8/1972 | Haak et al. | 508/385 |
| 3,933,657 | 1/1976 | Seni et al. | 508/167 |
| 4,203,854 | 5/1980 | Silverstein | 508/167 |
| 4,648,985 | 3/1987 | Thorsell et al. | 508/365 |
| 4,764,294 | 8/1988 | Habeeb et al. | 508/365 |
| 5,207,936 | 5/1993 | Anzai et al. | 508/168 |

*Primary Examiner*—Margaret Medley
*Attorney, Agent, or Firm*—Kim L. Muller

[57] ABSTRACT

A lubricating composition is disclosed comprising a base oil of mineral and/or synthetic origin in combination with molybdenum disulfide, zinc naphthenate and one or more metal dithiophosphates, and optionally one or more metal dithiocarbamates. A lubricating grease comprising such a composition in combination with a thickener, which may be a urea compound, a simple lithium soap or a lithium complex, is particularly suitable for lubricating constant velocity joints such as constant velocity ball joints.

11 Claims, No Drawings

LUBRICATING GREASE

FIELD OF THE INVENTION

The present invention relates to lubricating compositions, particularly to lubricating greases containing such compositions, and more particularly to lubricating greases for use in constant velocity joints such as constant velocity ball joints.

BACKGROUND OF THE INVENTION

The primary purpose of a lubrication is separation of solid surfaces moving relative to one another, to minimise friction and wear. The materials most frequently used for this purpose are oils and greases. The choice of lubricant is mostly determined by the particular application.

Lubricating greases are employed where heavy pressures exist, where oil drip from the bearings is undesirable or where the motion of the contacting surfaces is discontinuous so that it is difficult to maintain a separating film in the bearing. Because of design simplicity, decreased sealing requirements and less need for maintenance, greases are almost universally given first consideration for lubricating ball and roller bearings in electric motors, household appliances, automotive wheel bearings, machine tools or aircraft accessories. Greases are also used for the lubrication of small gear drives and for many slow-speed sliding applications.

Lubricating greases consist primarily of a fluid lubricant, such as an oil, and a thickener. Essentially, the same type of oil is employed in compounding a grease as would normally be selected for oil lubrication. Fatty acid soaps of lithium, calcium, sodium, aluminium and barium are most commonly used as thickeners. However, thickeners may be one of a variety of solid materials, including clays, complexes such as those of lithium, and urea compounds.

The base oil may be of mineral or synthetic origin. Base oils of mineral origin may be mineral oils, for example produced by solvent refining or hydro-processing. Base oils of synthetic origin may typically be mixtures of $C_{10-50}$ hydrocarbon polymers, for example liquid polymers of alpha-olefins. They may also be conventional esters, for example polyol esters. The base oil may also be a mixture of these oils. Preferably the base oil is that of mineral origin sold by the Royal Dutch/Shell Group of Companies under the designations "HVI" or "MVIN" or the synthetic hydrocarbon base oils sold by the Royal Dutch/Shell Group of Companies under the designation "XHVI" (trade mark).

The lubricating grease preferably contains 5 to 20% by weight of thickener.

Lithium soap thickened greases have been known for many years. Typically, the lithium soaps are derived from $C_{10-24}$, preferably $C_{15-18}$, saturated or unsaturated fatty acids or derivatives thereof. One particular derivative is hydrogenated castor oil, which is the glyceride of 12-hydroxystearic acid and is a particularly preferred fatty acid.

Greases thickened with complex thickeners are well known. In addition to a fatty acid salt, they incorporate into the thickener a complexing agent which is commonly a low to medium molecular weight acid or dibasic acid or one of its salts, such as benzoic acid or boric acid or a lithium borate.

Urea compounds used as thickeners in greases include the urea group (—NHCONH—) in their molecular structure. These compounds include mono-, di- or polyurea compounds, depending upon the number of urea linkages.

Various conventional grease additives may be incorporated into the lubricating greases, in amounts normally used in this field of application, to impart certain desirable characteristics to the grease, such as oxidation stability, tackiness, extreme pressure properties and corrosion inhibition. Suitable additives include one or more extreme pressure/antiwear agents, for example zinc salts such as zinc dialkyl or diaryl dithiophosphates, borates, substituted thiadiazoles, polymeric nitrogen/phosphorus compounds made, for example, by reacting a dialkoxy amine with a substituted organic phosphate, amine phosphates, sulfurized sperm oils of natural or synthetic origin, sulfurized lard, sulfurized esters, sulfurized fatty acid esters, and similar sulfurized materials, organo-phosphates for example according to the formula $(OR)_3P{=}O$ where R is an alkyl, aryl or aralkyl group, and triphenyl phosphorothionate; one or more overbased metal-containing detergents, such as calcium or magnesium alkyl salicylates or alkylarylsulphonates; one or more ashless dispersant additives, such as reaction products of polyisobutenyl succinic anhydride and an amine or ester; one or more antioxidants, such as hindered phenols or amines, for example phenyl alpha naphthylamine; one or more antirust or friction-modifying additives; one or more viscosity-index improving agents; one or more pour point depressing additives; and one or more tackiness agents. Solid materials such as graphite, finely divided molybdenum disulfide, talc, metal powders, and various polymers such as polyethylene wax may also be added to impart special properties.

In particular, the use of molybdenum disulfide is known from, for example, "*Solid Lubricant Additives—Effect of Concentration and other Additives on Anti-Wear Performance*", Bartz, Wear, 17 (1971) pages 421–432, to have the effect of reducing wear when incorporated in lubricating oils. Furthermore, in "*Interrelations between Molybdenum Disulfide and Oil Soluble Additives*", Bartz, NLGI Spokesman, December 1989, there is discussion of the use of molybdenum disulfide in combination with certain zinc dialkyldithio-phosphates. However, it is shown there that such a combination caused higher wear than when using either of those additives alone. Clearly such an antagonistic effect would make such a combination of additives quite unattractive for the reduction of friction levels.

SUMMARY OF THE INVENTION

However, it has now been found that reduced friction levels can in fact be attained using the combination of molybdenum disulfide and metal dithiophosphates by adding zinc naphthenate to such a combination. When such reduced friction greases are used in constant velocity joints this allows for the joints to operate at lower temperatures, which may in turn allow drive shafts to be designed into vehicles with permanently installed angles and/or it may allow for the joints to be reduced in size.

DETAILED DESCRIPTION OF THE INVENTION

In accordance with the present invention there is provided a lubricating composition comprising a base oil of mineral and/or synthetic origin in combination with molybdenum disulfide, zinc naphthenate and one or more metal dithiophosphates, and optionally one or more metal dithiocarbamates.

The metal in the metal dithiophosphates and/or metal dithiocarbamates is preferably selected from zinc, molybdenum, tin, manganese, tungsten and bismuth.

Preferably, the one or more metal dithiophosphates is/are selected from zinc dialkyl-, diaryl- or alkylaryl-dithiophosphates, and the one or more metal dithiocarbamates is/are selected from zinc dialkyl-, diaryl- or alkylaryl-dithiocarbamates, in which dithiophosphates and/or dithiocarbamates any alkyl moiety is straight chain or branched and preferably contains 1 to 12 carbon atoms.

In accordance with the present invention there is also provided a lubricating grease comprising a thickener in combination with a lubricating composition according to the present invention.

In the lubricating grease according to the present invention, preferably the ratio of the amount of molybdenum disulfide to the amount of metal dithio-phosphate is in the range 1:0.15 to 1:1 and the ratio of the amount of metal dithiophosphate to the amount of zinc naphthenate is in the range 1:0.2 to 1:3.0 and the ratio of the amount of molybdenum disulfide to the amount of zinc naphthenate is in the range 1:0.1 to 1:1.2.

The lubricating grease according to the present invention preferably contains molybdenum disulfide in the amount of 0.5 to 10% by weight, more preferably 1 to 4% by weight. It also preferably contains zinc naphthenate in the amount of 0.05 to 12% by weight, more preferably 0.3 to 2.4% by weight. It further preferably contains said one or more metal dithiophosphates in the total amount of 0.15 to 10% by weight, more preferably 1 to 3% by weight.

The thickener preferably comprises a urea compound, a simple lithium soap or a complex lithium soap. A preferred urea compound is a polyurea compound.

In accordance with the present invention there is further provided a method of lubricating a constant velocity joint comprising packing it with a lubricating grease according to the present invention.

In accordance with the present invention there is still further provided a constant velocity joint packed with a lubricating grease according to the present invention.

EXAMPLES

The present invention will now be described by reference to the following Examples:

Examples 1 to 20

Lubricating greases were prepared by the following procedure.

The lithium soap greases A, B and E were prepared by adding a slurry of $LiOH.H_2O$ and water in the proportions of 1 part $LiOH.H_2O$ to 5 parts water to hydrogenated castor oil or hydrogenated castor oil fatty acid in cold base oil and heating the mix in a sealed autoclave to 150° C. The steam was vented off and heating continued to 220° C. before the reaction mass was cooled and the product homogenized.

The lithium complex greases D were prepared by adding a 50% slurry of the $LiOH.H_2O$ and boric acid in water to hydrogenated castor oil fatty acid, calcium alkyl salicylate and calcium octoate in oil and then heating the charge to 210° C. with stirring. After slowly cooling to 80° C. the other additives to be included in the formulation were added. On further cooling to ambient temperature the resulting grease was homogenized.

The urea greases C were prepared by heating 5% of 4,4'-diphenylmethane diisocyanate in base oil to 70° C. and then adding 10.8% stearylamine. The mixture was then further heated to 150° C. before being cooled to 80° C. The other additives to be included in the formulation were then added. The formulated grease was then homogenised at ambient temperature.

The components of the prepared greases are set out in Table 1:

TABLE 1

| | EXAMPLE | | | | | | | | | |
|---|---|---|---|---|---|---|---|---|---|---|
| | 1 | 2 | 3 | 4 | 5 | 6 | 7 | 8 | 9 | 10 |
| Molybdenum disulfide % w | 3 | 3 | 3 | 3 | 3 | 3 | 3 | 3 | 3 | 3 |
| ZNDTP (1) % w | 1 | 1 | 1 | 1 | 2 | 1 | 3 | — | — | 1 |
| ZNDTP (2) % w | — | — | — | — | — | 1 | — | 1.2 | 1.2 | — |
| Zinc ** naphthenate % w | 1.2 | 0.3 | 0.6 | 2.4 | 1.2 | 1.2 | 1.2 | 1.2 | 2.4 | 1.2 |
| ZNDTC % w | — | — | — | — | — | — | — | — | — | — |
| Antioxidant % w | 0.5 | 0.5 | 0.5 | 0.5 | 0.5 | 0.5 | 0.5 | 0.5 | 0.5 | — |
| type | X | X | X | X | X | X | X | X | X | |
| Thickener | A | A | A | A | A | A | A | A | A | B |
| Base Oil | P | P | P | P | P | P | P | P | P | Q |

| | EXAMPLE | | | | | | | | | |
|---|---|---|---|---|---|---|---|---|---|---|
| | 11 | 12 | 13 | 14 | 15 | 16 | 17 | 18 | 19 * | 20 |
| Molybdenum disulfide % w | 3 | 3 | 3 | 3 | 3 | 3 | 1 | 3 | 3 | 4 |
| ZNDTP (1) % w | 1 | 1 | 1 | 1 | 1 | 1 | 1 | 1 | 1 | 1.3 |
| ZNDTP (2) % w | — | — | — | — | — | — | — | — | — | — |
| Zinc ** naphthenate % w | 1.2 | 1.2 | 0.3 | 1.2 | 1.2 | 1.2 | 1.2 | 1.2 | 1.2 | 1.6 |
| ZNDTC % w | — | — | — | — | — | 1 | — | — | — | — |
| Antioxidant % w | 0.5 | 0.5 | 0.5 | 0.5 | 0.5 | 0.5 | 0.5 | 0.5 | — | 0.5 |
| type | X | Y | X | X | X | X | X | X | | Y |
| Thickener | B | B | C | C | D | D | E | E | D | C |
| Base Oil | Q | Q | Q | Q | R | R | S | S | T | U |

A = 9.15% hydrogenated castor oil, 1.12% $LiOH.H_2O$ cooled at 6–7° C./min
B = 9% hydrogenated castor oil, 1.3% $LiOH.H_2O$ cooled at 1° C./min
C = 5% 4,4'-diphenylmethane diisocyanate, 10.8% stearylamine
D = 7.7% hydrogenated castor oil fatty acid, 2.2% boric acid, 2.6% $LiOH.H_2O$, 1.5% calcium alkyl salicylate, 1.5% calcium octoate
E = 7.8% hydrogenated castor oil, 1.1% $LiOH.H_2O$
P = MVIN 170 (80%) HVI 170 (5%) HVI 105 (15%)
Q = HVI 160B (75%) HVI 650 (25%)
R = HVI 160B (100%)
S = HVI 160B (78%) MVIN (22%)
T = HVI 160B (67%) HVI 650 (33%)
U = HVI 160B (70%) polyalphaolefin (30%)
X = PAN (phenyl alpha naphthylamine)
Y = aromatic amine
ZNDTP (1) = zinc di-4-methyl-2-pentyl dithiophosphate
ZNDTP (2) = zinc di-isobutyl dithiophosphate
ZNDTC = zinc diamyldithiocarbamate
* plus 1.5% triphenyl phosphorothionate
** amount of active ingredient in solution in mineral oil ("Manchem" (trade mark) zinc 8% MO)

Example 21

Measurement of Friction Coefficient

An oscillating SRV friction tester from Optimol Instruments was used for all the friction measurements, with a 10 mm ball on a flat lapped surface as test geometry. The test conditions were varied over a range of loads (200–500 Newtons) and temperatures (40° C. to 100° C.). An oscillation frequency of 50 Hertz and a stroke of 1.5 mm was used throughout. The friction coefficient was recorded after two hours of operation under fixed test conditions.

The friction coefficients of Examples 1 to 20 as measured on the SRV friction tester at 300 Newtons test load are set out in Table 2:

TABLE 2

| Ex. | Friction coefficient 300N test load at 100° C. |
|---|---|
| 1 | 0.046 |
| 2 | 0.054 |
| 3 | 0.048 |
| 4 | 0.073 |
| 5 | 0.068 |
| 6 | 0.073 |
| 7 | 0.070 |
| 8 | 0.049 |
| 9 | 0.068 |
| 10 | 0.050 |
| 11 | 0.068 |
| 12 | 0.048 |
| 13 | 0.070 |
| 14 | 0.053 |
| 15 | 0.048 |
| 16 | 0.075 |
| 17 | 0.046* |
| 18 | 0.035* |
| 19 | 0.068 |
| 20 | 0.055 |

*at 400N test load at 100° C.

Example 22

In order to demonstrate the improved performance of greases containing the three components molybdenum disulfide, zinc dialkyldithiophosphate and zinc naphthenate, friction coefficients and wear scar diameters of greases of Examples 1, 14 and 15 have been compared with respective similar greases containing no zinc naphthenate. The results are shown in Tables 3, 4 and 5.

The friction and wear measurements were made using the oscillating SRV friction tester described in Example 21. Wear was assessed by measuring the diameter of the wear scar on the ball at the end of the two hour test using an optical graticule.

TABLE 3

| Grease Composition | Friction coefficient 300N test load at 100° C. | Wear scar diameter (mm) 300N test load at 100° C. |
|---|---|---|
| Comparative A | 0.100 | 0.85 |
| Example 1 | 0.046 | 0.51 |

Comparative A contains 0.5% PAN, 3% molybdenum disulfide, 1% zinc di-4-methyl-2-pentyl dithiophosphate and thickener A

TABLE 4

| Grease Composition | Friction coefficient 300N test load at 100° C. | Wear scar diameter (mm) 300N test load at 100° C. |
|---|---|---|
| Comparative B | 0.080 | 0.67 |
| Example 14 | 0.053 | 0.59 |

Comparative B contains 0.5% PAN, 3% molybdenum disulfide, 1% zinc di-4-methyl-2-pentyl dithiophosphate and thickener C

TABLE 5

| Grease Composition | Friction coefficient 300N test load at 100° C. | Wear scar diameter (mm) 300N test load at 100° C. |
|---|---|---|
| Comparative C | 0.070 | 0.87 |
| Example 15 | 0.048 | 0.56 |

Comparative C contains 0.5% PAN, 3% molybdenum disulfide, 1% zinc di-4-methyl-2-pentyl dithiophosphate and thickener D It can be seen that in all three cases the addition of the zinc naphthenate to the molybdenum disulfide plus zinc dialkyldithiophosphate results in a substantial reduction in friction coefficient and wear scar diameter.

Example 23

In order to demonstrate the improved performance of greases of the present invention as compared to previously known greases, the friction coefficients of commercially available lithium soap-based, molybdenum disulfide-containing greases were measured by the procedure described in Example 21. The results are set out in Table 6, which for ease of comparison also contains the friction coefficient of Example 1 of the present invention:

TABLE 6

| Grease Composition | Friction coefficient 300N test load at 100° C. |
|---|---|
| Example 1 | 0.046 |
| Comp. D | 0.113 |
| Comp. E | 0.118 |
| Comp. F | 0.105 |

Comp. D = Molykote VN 2461C
Comp. E = "Retinax" AM (trade mark)
Comp. F = "Glitine 245 MO" (trade mark)

It can be seen quite clearly that the friction coefficient of Example 1 is substantially lower than that of each of the commercially available greases.

As indicated above, the grease formulations of the present invention can include one or more additives which impart certain desirable characteristics to formulations. In particular, further extreme-pressure/antiwear agents can be included, such as borates, substituted thiadiazoles, polymeric nitrogen/phosphorus compounds, amine phosphates, sulfurized esters and triphenyl phosphorothionate.

I claim:

1. A lubricating grease comprising a base oil selected from the group consisting of a mineral oil, a synthetic oil and a combination thereof, in combination with a thickner molybdenum disulfide, zinc naphthenate and one or more metal dithiophosphates wherein the metal is selected from the group consisting of zinc, molybdenum, tin, manganese, tungsten and bismuth.

2. The lubricating grease of claim 1 wherein it contains one or more metal dithiocarbamate wherein the metal is selected from the group consisting of zinc, molybdenum, tin, manganese, tungsten and bismuth.

3. A lubricating grease according to claim 2 wherein the one or more metal dithiophosphates is selected from the group consisting of zinc dialkyl-, diaryl- and alkylaryl-dithiophosphates, and the one or more metal dithiocarbamates is selected from the group consisting of zinc dialkyl-, diaryl- or alkylaryl-dithiocarbamates, in which dithiophosphates and/or dithiocarbamates contain a straight chain or branched alkyl moiety possessing between 1 to 12 carbon atoms.

4. A lubricating grease according to claim 3 in which the ratio of the amount of molybdenum disulfide to the amount of metal dithiophosphate is in the range 1:0.15 to 1:1, the ratio of the amount of metal dithio-phosphate to the amount of zinc naphthenate is in the range 1:0.2 to 1:3.0 and the ratio of the amount of molybdenum disulfide to the amount of zinc naphthenate is in the range 1:0.1 to 1:1.2.

5. A lubricating grease according to claim 4 which contains molybdenum disulfide in an amount of 0.5 to 10% by weight.

6. A lubricating grease according to claim 5 which contains zinc naphthenate in the amount of 0.05 to 12% by weight.

7. A lubricating grease according to claim 6 which contains one or more metal dithiophosphates in the total amount of 0.15 to 10% by weight.

8. A lubricating grease according to claim 1 wherein the thickener comprises a urea compound, a simple lithium soap or a complex lithium soap.

9. The lubricating grease of claim 8 wherein the urea compound comprises a polyurea compound.

10. A method of lubricating a constant velocity joint comprising packing it with a lubricating grease according to claim 4.

11. A constant velocity joint packed with a lubricating grease according to claim 4.

* * * * *